US007827617B2

(12) United States Patent
Trainor et al.

(10) Patent No.: US 7,827,617 B2
(45) Date of Patent: Nov. 9, 2010

(54) CHIN STRAP ASSEMBLY FOR HELMET

(75) Inventors: Bill Trainor, Moscow, PA (US); Ray Kryeski, Clarks Summit, PA (US)

(73) Assignee: BAE Systems Specialty Defense Systems of Pennsylvania, Inc., Jessup, PA (US)

( * ) Notice: Subject to any disclaimer, the term of this patent is extended or adjusted under 35 U.S.C. 154(b) by 1327 days.

(21) Appl. No.: 11/255,680

(22) Filed: Oct. 21, 2005

(65) Prior Publication Data

US 2007/0089219 A1 Apr. 26, 2007

(51) Int. Cl.
*F41H 1/04* (2006.01)

(52) U.S. Cl. ..... 2/6.6; 2/410

(58) Field of Classification Search ..... 2/410, 2/6.6, 411, 416, 417, 422
See application file for complete search history.

(56) References Cited

U.S. PATENT DOCUMENTS 2,464,620 A * 3/1949 Tinnerman ..... 248/74.3
3,470,564 A * 10/1969 Aileo ..... 2/423
3,714,668 A 2/1973 Mirabella
4,703,879 A 11/1987 Kastendieck et al.
4,741,054 A 5/1988 Mattes
4,856,119 A 8/1989 Häberle
5,077,839 A 1/1992 Keller
5,291,880 A * 3/1994 Almovist et al. ..... 128/201.22
5,581,819 A 12/1996 Garneau
5,898,950 A * 5/1999 Spyrou et al. ..... 2/421
5,983,405 A 11/1999 Casale
6,260,197 B1 * 7/2001 Hoogewind ..... 2/8.3
6,311,338 B1 * 11/2001 Galet ..... 2/421
6,804,829 B2 10/2004 Crye et al.
6,854,133 B2 * 2/2005 Lee et al. ..... 2/421
6,968,575 B2 * 11/2005 Durocher ..... 2/425

* cited by examiner

*Primary Examiner*—Shaun R Hurley
*Assistant Examiner*—Andrew W Sutton
(74) *Attorney, Agent, or Firm*—Kane Kessler, P.C.; Paul E. Szabo

(57) ABSTRACT

A helmet chin strap assembly includes a nape pad that is adjustably attached to straps extending below the ears of the user. The straps of the assembly are connected to a helmet by a coupling unit including an anchor strap and a plastic or polymeric reinforcement member attached to the strap. The strap and the reinforcement member are provided with aligned holes through which a threaded post is inserted to cooperate with a bolt or screw to attach the anchor strap to a helmet.

17 Claims, 7 Drawing Sheets

CHIN STRAP ASSEMBLY FOR HELMET

BACKGROUND OF THE INVENTION

This invention relates to chin straps used to releasably fasten helmets to the heads of users. The invention is particularly useful in the field of military helmets.

The primary requirement for military helmets is that they adequately protect soldiers' heads in the conditions of battle. Thus, the helmets must be strong enough to withstand impacts by bullets and exploding artillery shells. It is desirable that the accessory features of a helmet, such as the chin strap and the coupling elements attaching the chin strap to the helmet, also exhibit advantages of strength and impact resistance, to the extent possible.

The fit of a helmet to the head of a user is also implicated in safety. An ill-fitting helmet may reduce protection. Thus, it is desirable to provide a chin strap assembly that is adjustable for optimizing fit.

OBJECTS OF THE INVENTION

It is an object of the invention to provide an improved chin strap assembly for helmets.

A more particular object of the present invention is to provide a chin strap assembly with enhanced strength and reliability.

A further object of the present invention is to provide a chin strap assembly with adjustable features.

These and other objects of the present invention will be apparent from the drawings and descriptions herein. Although every object of the invention is believed attained in at least one embodiment of the invention, there is not necessarily any single embodiment that achieves all of the objects of the invention.

SUMMARY OF THE INVENTION

A helmet chin strap assembly comprises, in accordance with the present invention, a plurality of straps connected to one another for removably attaching a helmet to a user's head, the straps including a first lower strap and a second lower strap segment each disposable below a respective ear of the user. A nape pad is adjustably attached to the first lower strap and the second lower strap.

Pursuant to another feature of the present invention, the nape pad carries an auxiliary strap defining a pair of loops at opposite ends. The lower straps pass through respective ones of the loops so that the nape pad is slidably connected to the straps. Thus, the user can adjust the position of the nape pad along his or her neck.

Preferably, the auxiliary strap has an adjustable effective length, so as to enable the user to change a distance between the first lower strap and the second lower strap at the nape pad. Thus, the user can modify the proximity of the straps to the user's neck and the snugness of the fit of the chin strap assembly. The auxiliary strap may be provided with hook and loop fasteners to enable adjustment of the strap's effective length.

The nape pad may be provided with a plurality of additional loops through which the auxiliary strap passes. The loops of the auxiliary strap may be located on opposite outer sides of the second loops so that each of the loops of the auxiliary strap is located on a side of one of the additional loops opposite another of the additional loops.

A coupling assembly for a helmet chin strap assembly comprises, in accordance with the present invention, an anchor strap and a plastic or polymeric reinforcement member attached to the strap. A connector member is attached to the strap for attaching a chin strap assembly to the anchor strap. The strap and the reinforcement member are provided with aligned holes through which a threaded post is inserted to cooperate with a bolt or screw to attach the anchor strap to a helmet.

Pursuant to another feature of the present invention, the reinforcement member is connected to the anchor strap at the holes by a melted plastic or polymeric bond. To create this bond, a heated pin or arbor is inserted into the holes in the anchor strap and the reinforcement element, melting the plastic or polymeric material of the reinforcement member. The melted material flows along and into the threading, fibers or yarns of the anchor strap (which is preferably made of a woven fabric material) and subsequently hardens there. The pin or arbor may remain in place during the cooling of the melted plastic or polymeric material. Optionally, the pin or arbor is itself cooled by an external heat sink. Alternatively, the hot pin or arbor may be removed and replaced with a cooling pin or arbor that has a lower temperature. The cooled plastic or polymeric material causes the holes in the reinforcement member and the anchor strap to assume the diameter of the cooling pin or arbor, thereby facilitating a close match to the diameter of the post.

Pursuant to another feature of the present invention, the connector member on the anchor strap of the connector or coupling assembly is a buckle. This connector enables the user to adjust the lengths of a strap connected to a helmet via the connector or coupling assembly.

The reinforcement member may be connected to the anchor strap by stitching. In a preferred embodiment of the invention, the reinforcement member takes the form of a rectangular sheet that is stitched along its periphery to the anchor strap.

A particular embodiment of a helmet chin strap assembly comprises, in accordance with the present invention, (a) a chin strap segment provided at one end with a quick-release first connector element, (b) a first temple strap segment connected at one end to an end of the chin strap segment opposite the first connector element, (b) a second temple strap segment provided at one end with a quick-release second connector element for cooperating with the first connector element to attach to the chin strap segment, the first temple strap segment and the second temple strap segment being disposable forward of respective ears of a user, (c) a first lower strap segment connected to the chin strap segment and the first temple strap segment, (d) a second lower strap segment connected to the second temple strap segment and the second connector element, the first lower strap segment and the second lower strap segment being disposable below the respective ears of the user, (e) a nape pad adjustably connected to the first lower strap segment and the second lower strap segment, and (f) a plurality of coupling units for attaching respective ones of the first temple strap segment, the second temple strap segment, the first lower strap segment, and the second lower strap segment to the helmet. Each of the coupling units comprises an anchor strap; a plastic or polymeric reinforcement member attached to the anchor strap, and a screw or bolt element passable through the anchor strap and the reinforcement member and the helmet.

As discussed above, the anchor strap and the reinforcement member of the coupling unit are provided with aligned holes, the screw or bolt element being threadingly connectable to a threaded post insertable through the holes. The coupling unit may further comprise a connector member attachable to one of the first temple strap segment, the second temple strap segment, the first lower strap segment, and the second lower strap segment. Also the reinforcement member is connected to the strap at the holes by a melted plastic or polymeric bond.

As further discussed above, the nape pad may carry an auxiliary strap defining a pair of loops at opposite ends, the first lower strap segment and the second lower strap segment passing through respective ones of the loops so that the nape pad is slidably connected to the first lower strap segment and the second lower strap segment. The auxiliary strap preferably has an adjustable effective length, so as to enable the user to change a distance between the first lower strap segment and the second lower strap segment at the nape pad.

According to a further feature of the present invention, the first temple strap segment and the first lower strap segment are parts of one strap folded over and stitched to the chin strap segment.

According to yet another feature of the present invention, the helmet chin strap assembly further comprises a second chin strap segment connected at one end to the first connector element and at an opposite end to the first temple strap segment and the first lower strap segment.

A helmet chin strap assembly in accordance with the present invention has substantial adjustability. The coupling unit of a chin strap assembly in accordance with the present invention confers a marked degree of strength to a helmet assembly.

DETAILED DESCRIPTION

Figure 3:
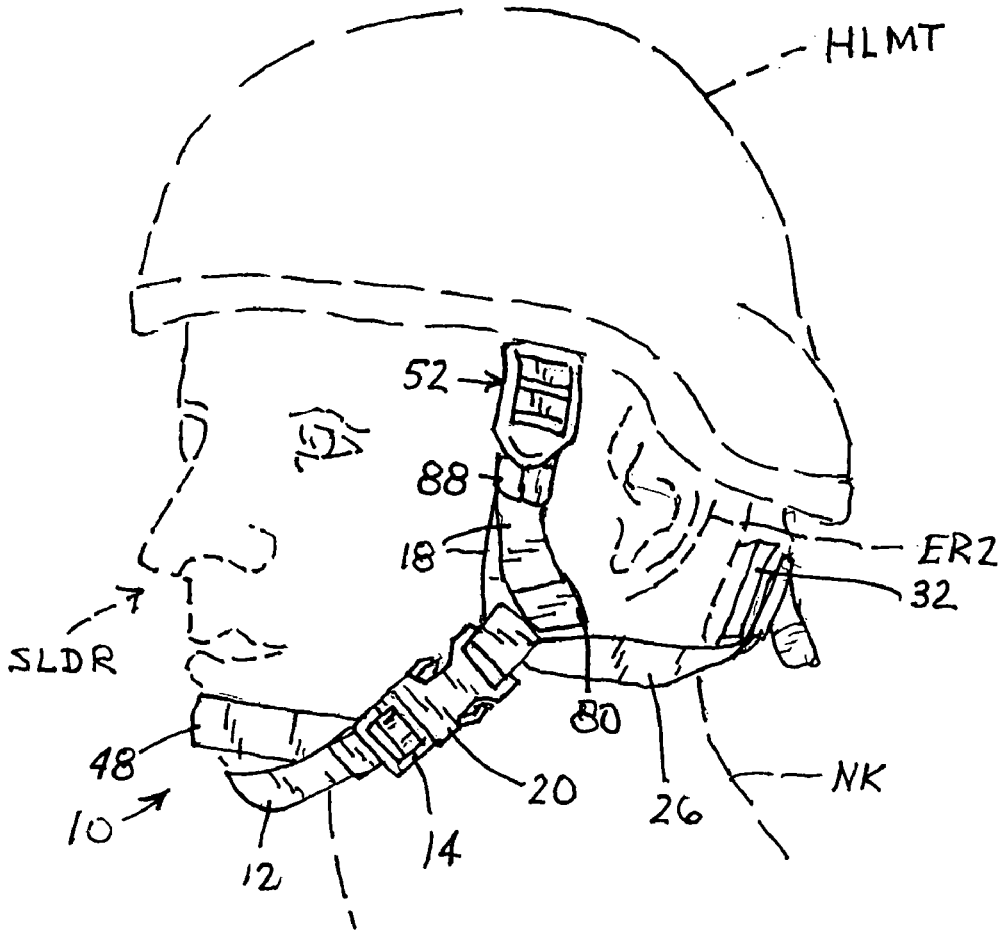
FIG. 3 is a perspective view similar to FIG. 2, showing the chin strap assembly attached to a helmet on a user's head.
Figure 4:
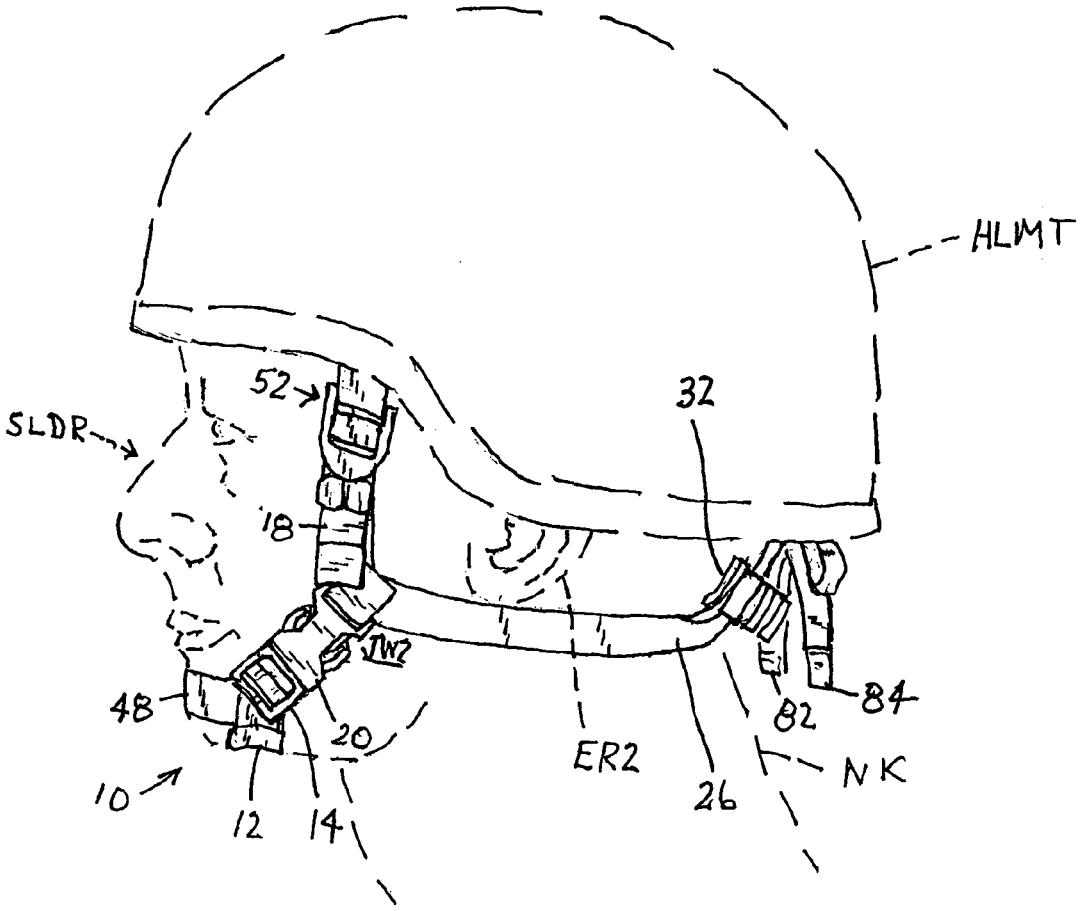
FIG. 4 is a left side elevational view of the chin strap assembly of FIGS. 1-3, showing the assembly on a helmet as worn by a user.
Figure 5:
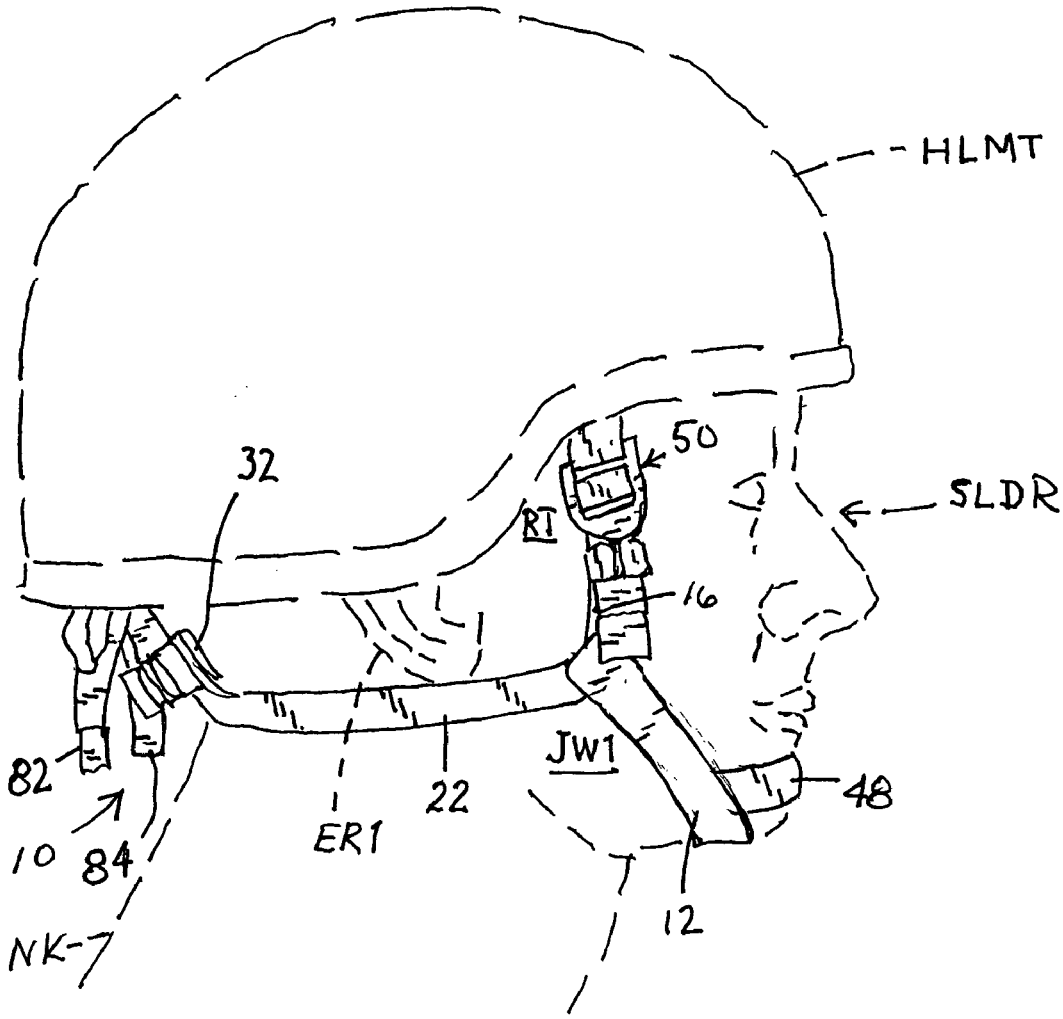
FIG. 5 is a right side elevational view of the chin strap assembly of FIGS. 1-4, showing the assembly on a helmet as worn by a user.
Figure 6:
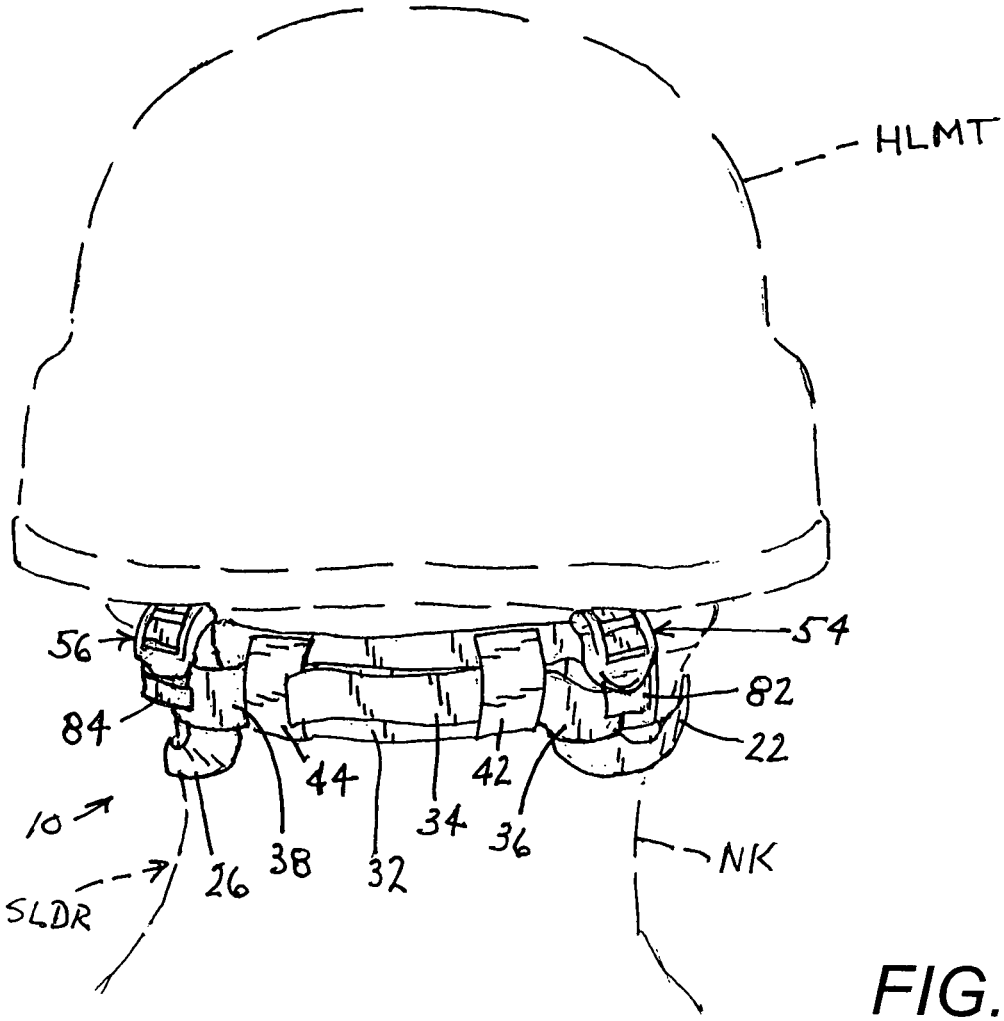
FIG. 6 is a rear elevational view of the chin strap assembly of FIGS. 1-5, showing the assembly on a helmet as worn by a user.

A helmet chin strap assembly 10 comprises a chin strap segment 12 provided at one end with a quick-release connector element 14. A temple strap segment 16, which extends from the jaw JW1 of a user SLDR past the user's right temple RT (FIG. 5) during use of the chin strap assembly, is connected at one end to an end of chin strap segment 12 opposite connector element 14. Another temple strap segment 18, which extends from the jaw JW2 of user SLDR past the user's left temple LT (FIGS. 3 and 4) during use of the chin strap assembly, is provided at one end with a quick-release connector element 20 for cooperating with connector element 14 to attach the right temple strap segment to the chin strap segment. Temple strap segments 16 and 18 are disposable forward of respective ears ER1 and ER2 of user SLDR.

A first lower strap segment 22 is connected to chin strap segment 12 and first temple strap segment 16 by stitching 24. Temple strap segment 16 and lower strap segment 22 are sections of the same unitary strap (not separately designated) which is folded over at stitching 24. A second lower strap segment 26 is connected to temple strap segment 18 and connector element 20. Temple strap segment 18 and lower strap segment 26 are sections of the same unitary strap (not separately designated) which is folded over and stitched at 28 to a web section 30 linked to connector element 20. Lower strap segments 22 and 26 are disposable below the respective ears ER1 and ER2 of user SLDR.

A nape pad 32 is adjustably connected to lower strap segments 22 and 26. During use of the chin strap assembly 10, nape pad 32 extends transversely across a neck NK of user SLDR. Nape pad 32 carries an auxiliary strap 34 extending longitudinally across a middle region (not separately designated) of the nape pad and defining a pair of loops 36 and 38 at opposite ends. Lower strap segment 22 and 26 pass through loops 36 and 38, respectively so that nape pad 32 is slidably connected to the lower strap segments. Auxiliary strap 34 has an adjustable effective length, so as to enable user SLDR to change a distance between lower strap segments 22 and 26 at nape pad 32. Thus, user SLDR can modify the proximity of straps 22 and 26 to his or her neck NK and adjust the snugness of the fit of chin strap assembly 10. Auxiliary strap 34 is provided with hook and loop fasteners 40 to enable adjustment of the strap's effective length.

Nape pad is provided with transversely oriented loops 42 and 44 through which auxiliary strap 34 passes. Loops 36 and 38 of auxiliary strap 34 are located on opposite outer sides of loops 42 and 44. Accordingly, loop 36 is located on a side of transverse loop 42 opposite loop 44, while loop 38 is located on a side of transverse loop 44 opposite loop 42.

For strength and durability, nape pad 32 is provided along its periphery with multiple stitching 46. Stitching 46 connects transverse loops or straps 42 and 44 to the body of pad 32.

Helmet chin strap assembly 10 further comprises a second chin strap segment 48 connected at one end to connector element 14 via chins strap segment 12 and at an opposite end to temple strap segment 16 and lower strap segment 22 also via chin strap segment 12.

Figure 1:
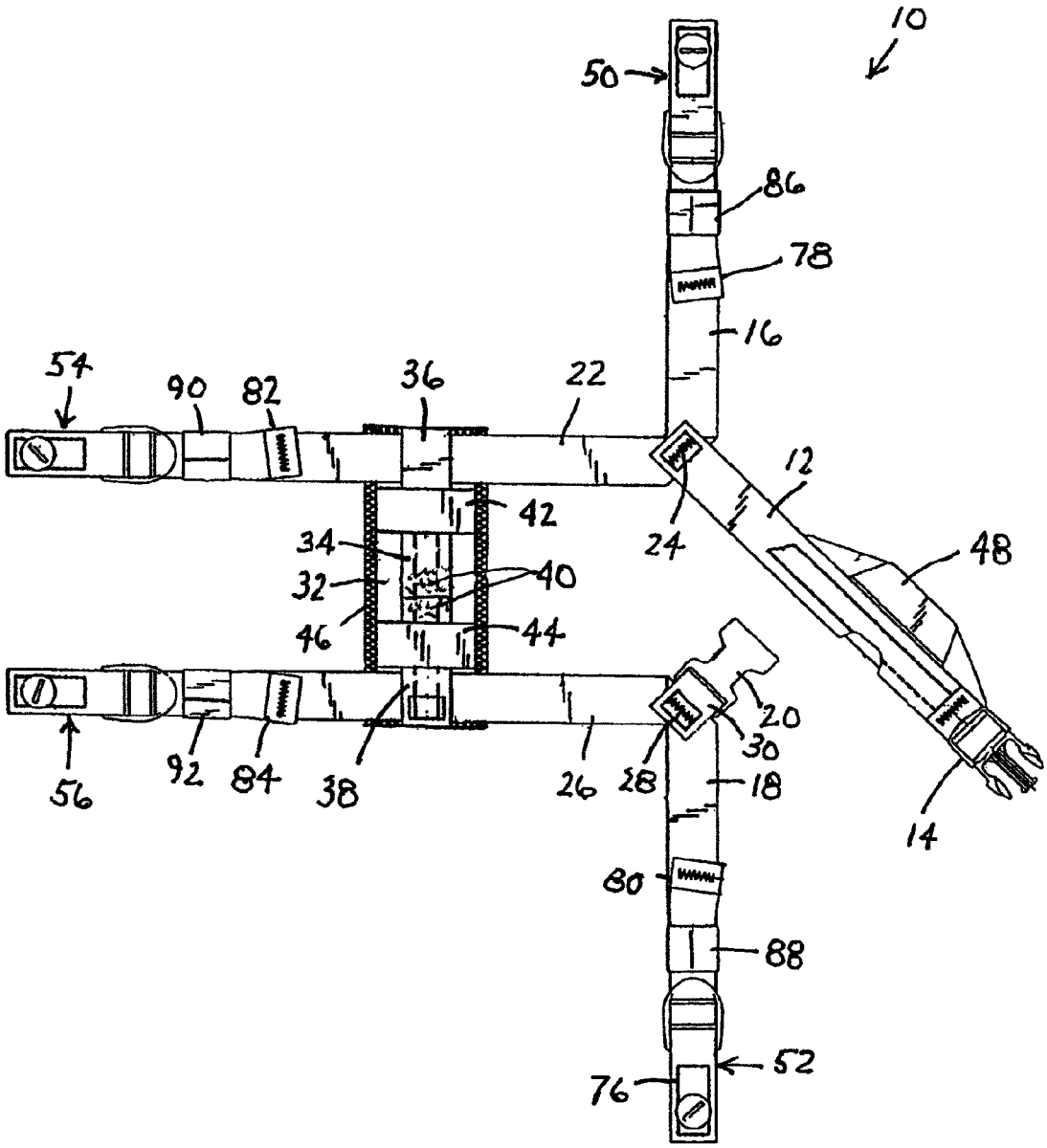
FIG. 1 is a top plan view of a chin strap assembly in accordance with the present invention, showing the assembly in a laid out configuration.
Figure 7:
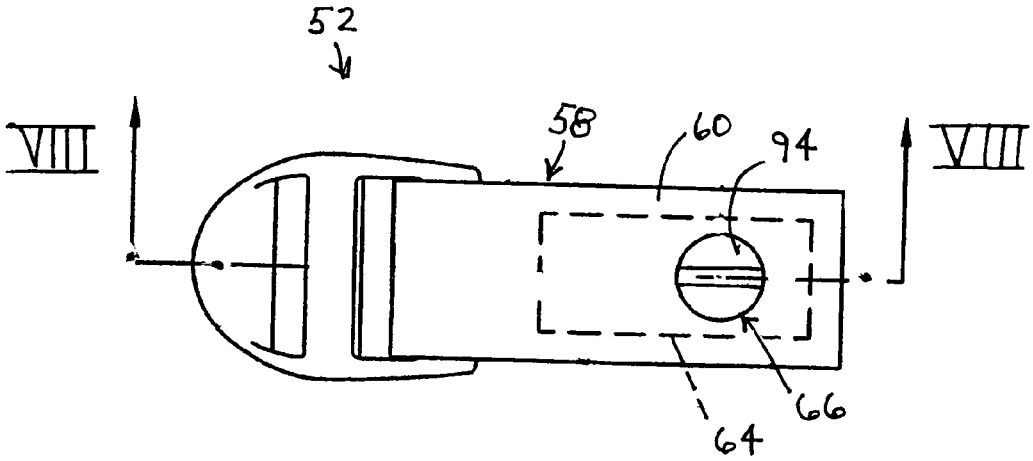
FIG. 7 is a top plan view of a coupling unit included in four iterations in the chin strap assembly of FIGS. 1-6.
Figure 8:
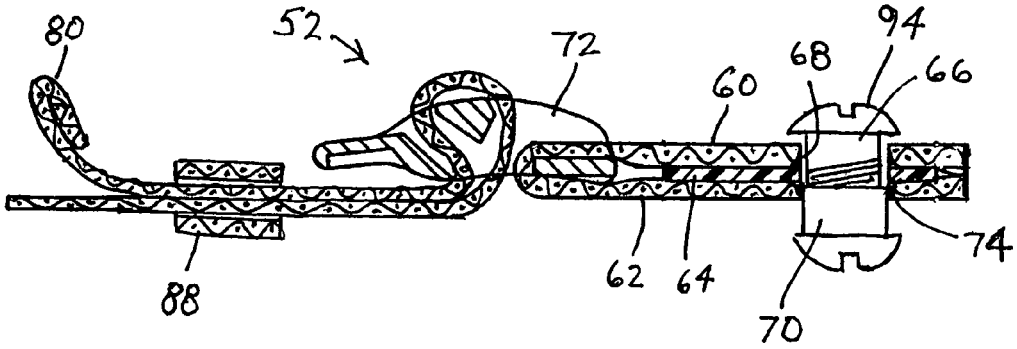
FIG. 8 is a cross-sectional view taken along line VIII-VIII in FIG. 7.

Strap segments 16, 18, 22 and 26 are connectable at their free ends (FIG. 1) to a helmet HLMT of user SLDR via respective coupling units 50, 52, 54, and 56. Coupling units 50, 52, 54, and 56 are identical to one another and are described now with reference to a generic coupling unit 52 shown in detail in FIGS. 7 and 8. Coupling unit 52 comprises an anchor strap 58 doubled over to form two strap halves 60 and 62. A flat plastic or polymeric reinforcement member 64 is sandwiched between strap halves 60 and 62 sections attached to the anchor strap. A screw or bolt element 66 passes through anchor strap halves 60 and 62 and reinforcement member 64, as well as helmet HLMT.

1. Anchor strap halves 60 and 62 and reinforcement member 64 are provided with aligned holes 68 into which a threaded post 70 is inserted. Post 70 is closely matched in diameter to the diameters of holes 68, i.e., post 70 has a close tolerance or fit with respect to holes 68. Post 70 threadingly receives screw or bolt element 66 to couple anchor strap 58 to helmet HLMT. Coupling unit 52 further comprises a connector member 72 in the form of a plastic buckle attachable to one of temple strap segments 16 and 18 and lower strap segments 22 and 26 (temple strap segment 18 shown in FIG. 8).

During manufacture, reinforcement member 64 is connected to anchor strap 58 at the holes 68 by a melted plastic or polymeric bond 74. To create this bond, a heated pin or arbor (not shown) is inserted into perforations formed in anchor strap halves 60 and 62 and reinforcement member 64. The heated pin or arbor melts a limited portion of reinforcement member. The melted material flows along and into the threading, fibers or yarns of anchor strap 58 and subsequently hardens there. The pin or arbor may remain in place during the cooling of the melted plastic or polymeric material. Optionally, the pin or arbor is itself cooled by an external heat sink. Alternatively, the hot pin or arbor may be removed and replaced with a cooling pin or arbor that has a lower temperature. The cooled plastic or polymeric material causes the holes in the reinforcement member and the anchor strap to assume the diameter of the cooling pin or arbor, thereby facilitating a close match to the diameter of the post.

Strap segments 12, 16, 18, 22, and 26 and anchor straps 58 are made of a heavy woven fabric material. Reinforcement member 64 is connected to anchor strap 58 by stitching 76 (FIG. 1) along the periphery of the rectangular reinforcement member 64.

Double-over and stitched, free ends 78, 80, 82, and 84 of strap segments 16, 18, 22, and 26 are insertable through respective holding loops 86, 88, 90 and 92. Loops 86, 88, 90 and 92 are each formed by stitching together free ends of a piece of fabric material so that the tips point inwardly towards the respective strap segments 16, 18, 22, and 26 and their conjoined free ends 78, 80, 82, and 84. The tolerances of strap segments 16, 18, 22, and 26 and the respective buckles 72 are small, thereby making it difficult for the straps to wiggle free during normal use.

Figure 2:
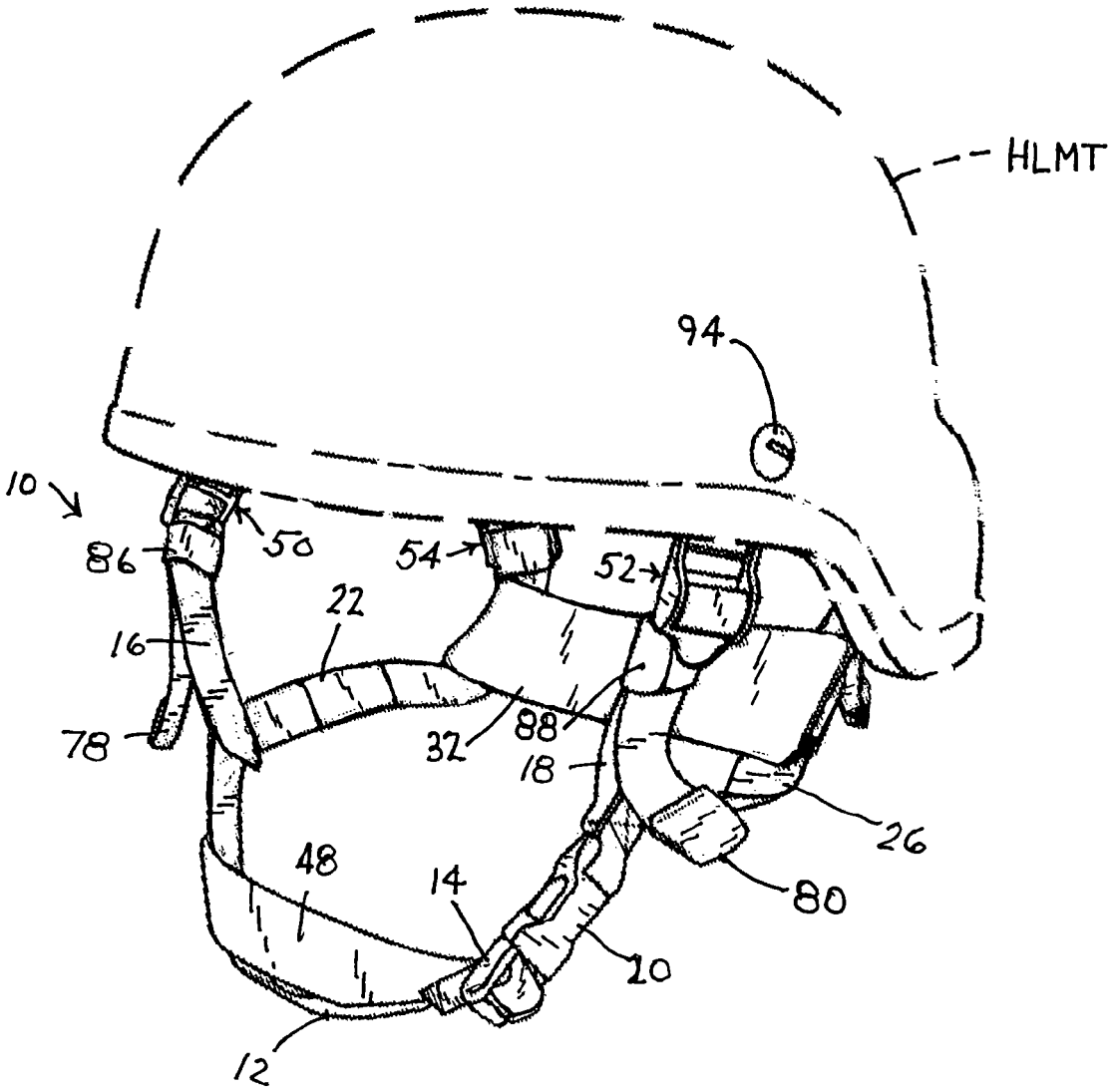
FIG. 2 is a perspective view of the chin strap assembly of FIG. 1, showing the assembly attached to a helmet.

Chin strap assembly 10, including coupling units 50, 52, 54, and 56, is designed to satisfy current official ballistic testing requirements. At least some of these requirements are that a test helmet HLMT is to be mounted onto a head form and then subjected to ballistic testing. The testing is done using a 9 mm 124 grain bullet traveling at 1425 feet per second. Several shots are taken at different locations about the helmet. One of these shots must hit directly on top of a screw head 94 (FIGS. 2, 7, and 8) at 0 degree obliquity. When this occurs, neither the screw 66 nor any part of the mounting hardware can break off and penetrate a clay backing inside of the helmet HLMT. Because the chinstrap coupling units or tabs 50, 52, 54, and 56 are made of flexible nylon-webbing anchor straps 58 provided with plastic reinforcement members 64, there is almost no chance of any part of coupling units 50, 52, 54, and 56 becoming a projectile and penetrating the clay surface during this violent event. These ballistic results are achieved in part by providing screw head 94 with an enlarged diameter and an enhanced mass. This chance in the proportions of bolt or screw 66 dramatically decreases the chances that screw head 94 will pass through the helmet in the event of a bullet impact.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein area proffered by way of example to facilitate comprehension of the invention and should not be construed to limit the scope thereof.

What is claimed is:

1. A helmet chin strap assembly comprising:

a chin strap segment provided at one end with a quick-release first connector element;

a first temple strap segment connected at one end to an end of said chin strap segment opposite said first connector element;

a second temple strap segment provided at one end with a quick-release second connector element for cooperating with said first connector element to attach to said chin strap segment, said first temple strap segment and said second temple strap segment being disposable forward of respective ears of a user;

a first lower strap segment connected to said chin strap segment and said first temple strap segment;

a second lower strap segment connected to said second temple strap segment and said second connector element, said first lower strap segment and said second lower strap segment being disposable below the respective ears of the user;

a nape pad adjustably connected to said first lower strap segment and said second lower strap segment, said nape pad being slidably connected to said first lower strap and said second lower strap, said nape pad having an adjustable effective length so as to enable the user to change a distance between said first lower strap and said second lower strap at said nape pad; and a plurality of coupling units for attaching respective ones of said first temple strap segment, said second temple strap segment, said first lower strap segment, and said second lower strap segment to the helmet, each of said coupling units comprising:

an anchor strap;

a plastic or polymeric reinforcement member attached to said anchor strap; and a screw or bolt element passable through said anchor strap and said reinforcement member and the helmet;

wherein said first and second temple strap segments extend generally vertically downward from the helmet, and said chin strap segment extends between said first and second temple strap segments at a downward and forward orientation to be disposable under the chin of a user.

2. The helmet chin strap assembly defined in claim 1 wherein said anchor strap and said reinforcement member are provided with aligned holes, said screw or bolt element being threadingly connectable to a threaded post insertable through said holes, said coupling unit further comprising a connector member attachable to one of said first temple strap segment, said second temple strap segment, said first lower strap segment, and said second lower strap segment.

3. The helmet chin strap assembly defined in claim 2 wherein said reinforcement member is connected to said strap at said holes by a melted plastic or polymeric bond.

4. The helmet chin strap assembly defined in claim 2 wherein said connector member is a buckle.

5. The helmet chin strap assembly defined in claim 2 wherein said reinforcement member is connected to said anchor strap by stitching.

6. The helmet chin strap assembly defined in claim 1 wherein said nape pad carries an auxiliary strap defining a pair of loops at opposite ends, said first lower strap segment and said second lower strap segment passing through respective ones of said loops so that said nape pad is slidably connected to said first lower strap segment and said second lower strap segment.

7. The helmet chin strap assembly defined in claim 6 wherein said auxiliary strap has an adjustable effective length, so as to enable the user to change a distance between said first lower strap segment and said second lower strap segment at said nape pad.

8. The helmet chin strap assembly defined in claim 7 wherein said auxiliary strap is provided with hook and loop fasteners to enable adjustment of said effective length.

9. The helmet chin strap assembly defined in claim 6 wherein said loops are first loops, said nape pad being provided with a plurality of second loops, said auxiliary strap passing at least in part through said second loops, said first loops being located on opposite outer sides of said second loops so that each of said first loops is located on a side of one of said second loops opposite another of said second loops.

10. The helmet chin strap assembly defined in claim 1 wherein said first temple strap segment and said first lower strap segment are parts of one strap folded over and stitched to said chin strap segment.

11. The helmet chin strap assembly defined in claim 1 wherein said chin strap segment is a first chin strap segment, further comprising a second chin strap segment connected at one end to said first connector element and at an opposite end to said first temple strap segment and said first lower strap segment.

12. A helmet chin strap assembly comprising: a plurality of straps connected to one another for removably attaching a helmet to a user's head, said straps including a first lower strap and a second lower strap segment each disposable below a respective ear of the user; and a nape pad adjustably attached to said first lower strap and said second lower strap;

wherein said nape pad carries an auxiliary strap defining a pair of loops at opposite ends, said first lower strap and said second lower strap passing through respective ones of said loops so that said nape pad is slidably connected to said first lower strap and said second lower strap; and wherein said auxiliary strap has an adjustable effective length, so as to enable the user to change a distance between said first lower strap and said second lower strap at said nape pad.

13. The helmet chin strap assembly defined in claim 12 wherein said auxiliary strap is provided with hook and loop fasteners to enable adjustment of said effective length.

14. The helmet chin strap assembly defined in claim 12 wherein said loops are first loops, said nape pad being provided with a plurality of second loops, said auxiliary strap passing at least in part through said second loops, said first loops being located on opposite outer sides of said second loops so that each of said first loops is located on a side of one of said second loops opposite another of said second loops.

15. A helmet chin strap assembly as set forth in claim 1 wherein each one of said coupling units comprises:

an anchor strap having two overlying layers of a fabric material made from threading, fibers or yarns;

a plastic reinforcement member having a main body portion sandwiched between the two overlying fabric layers and having an attachment portion embedded into and between the threading, fibers or yarns of the fabric layers to secure the reinforcement member to the anchor strap;

a fastener opening extending through the two overlying fabric layers and through the reinforcement member for receiving a fastener therethrough for fastening the anchor strap to a helmet; and a fastener for extending through said fastener opening for fastening the anchor strap and reinforcement member to the helmet.

16. A coupling unit for coupling a helmet strap assembly to a helmet, comprising:

an anchor strap having two overlying layers of a fabric material made from threading, fibers or yarns;

a plastic reinforcement member having a main body portion sandwiched between the two overlying fabric layers and having an attachment portion embedded into and between the threading, fibers or yarns of the fabric layers to secure the reinforcement member to the anchor strap;

a fastener opening extending through the two overlying fabric layers and through the reinforcement member for receiving a fastener therethrough for fastening the anchor strap to a helmet; and a fastener for extending through said fastener opening for fastening the anchor strap and reinforcement member to the helmet.

17. A helmet chin strap assembly comprising:

a plurality of straps connected to one another for removably attaching a helmet to a user's head; and a plurality of coupling assemblies for connecting respective ones of said straps to the helmet, each one of said coupling assemblies comprising:

an anchor strap having two overlying layers of a fabric material made from threading, fibers or yarns;

a plastic reinforcement member having a main body portion sandwiched between the two overlying fabric layers and having an attachment portion embedded into and between the threading, fibers or yarns of the fabric layers to secure the reinforcement member to the anchor strap;

a fastener opening extending through the two overlying fabric layers and through the reinforcement member for receiving a fastener therethrough for fastening the anchor strap to a helmet; and a fastener for extending through said fastener opening for fastening the anchor strap and reinforcement member to the helmet.

* * * * *